US007360513B2

(12) United States Patent
Takemura et al.

(10) Patent No.: US 7,360,513 B2
(45) Date of Patent: Apr. 22, 2008

(54) INTERNAL COMBUSTION ENGINE THAT USES A VARIABLE COMPRESSION RATIO DEVICE

(75) Inventors: Shinichi Takemura, Yokohama (JP); Takanobu Sugiyama, Yokohama (JP); Katsuya Moteki, Tokyo (JP); Yoshiaki Tanaka, Fujisawa (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 5 days.

(21) Appl. No.: 11/354,532

(22) Filed: Feb. 15, 2006

(65) Prior Publication Data

US 2006/0180118 A1 Aug. 17, 2006

(30) Foreign Application Priority Data

Feb. 15, 2005 (JP) ..... 2005-037540

(51) Int. Cl.
*F02D 15/02* (2006.01)

(52) U.S. Cl. ..... 123/48 B; 123/48 R

(58) Field of Classification Search ..... 123/48 R, 123/48 B, 78 F

See application file for complete search history.

(56) References Cited

U.S. PATENT DOCUMENTS 4,449,489 A * 5/1984 Williams ..... 123/48 R
4,834,031 A * 5/1989 Katoh et al. ..... 123/48 R
5,025,757 A * 6/1991 Larsen ..... 123/48 R
5,255,637 A * 10/1993 Schechter ..... 123/48 R
6,581,552 B2 * 6/2003 Kreuter ..... 123/48 R
6,668,768 B2 * 12/2003 Styron et al. ..... 123/48 B
6,691,655 B2 * 2/2004 Aoyama et al. ..... 123/90.16
6,705,255 B2 * 3/2004 Papaioannou et al. .... 123/48 R
6,769,404 B2 * 8/2004 Aoyama et al. ..... 123/406.29
6,857,401 B1 * 2/2005 Styron ..... 123/48 B
6,915,766 B2 * 7/2005 Aoyama et al. ..... 123/78 E
6,920,847 B2 * 7/2005 Hiyoshi et al. ..... 123/48 B
6,990,934 B2 * 1/2006 Sugiyama et al. ..... 123/48 B
7,047,917 B2 * 5/2006 Akihisa et al. ..... 123/48 R
7,213,543 B2 * 5/2007 Miyashita ..... 123/48 C
2003/0111067 A1 * 6/2003 Russell et al. ..... 123/685
2004/0112310 A1 * 6/2004 Osamura et al. ..... 123/48 B

FOREIGN PATENT DOCUMENTS

JP 2001-263113 9/2001

* cited by examiner

*Primary Examiner*—Stephen K. Cronin
*Assistant Examiner*—Jason Benton
(74) *Attorney, Agent, or Firm*—Young Basile

(57) ABSTRACT

A variable compression ratio mechanism that changes the compression ratio according to the rotation angle of a control shaft, wherein a stopper is provided at the highest compression ratio side for regulating the rotation of the control shaft. Then, the output detected by a compression ratio sensor for detecting the rotation angle of the control shaft when the stopper is in an abutted state is read. An adjustment value is learned in order to revise the sensor output based on the detected output.

28 Claims, 9 Drawing Sheets

INTERNAL COMBUSTION ENGINE THAT USES A VARIABLE COMPRESSION RATIO DEVICE

CROSS-REFERENCE TO RELATED APPLICATIONS

The present application claims priority under 35 U.S.C. §119 of Japanese Patent Application No. 2005-037540, titled "A VARIABLE COMPRESSION RATIO DEVICE FOR AN INTERNAL COMBUSTION ENGINE," filed on Feb. 15, 2005, the entire content of which is expressly incorporated by reference herein.

TECHNICAL FIELD

The present invention pertains to an internal combustion engine that has a variable compression ratio device that changes the capacity of the combustion chamber of the internal combustion engine in order to make the compression ratio variable.

BACKGROUND

Unexamined Patent Application Publication No. JP2001-263113 discloses a variable compression ratio device that changes the capacity of the combustion chamber of an internal combustion engine in order to change the compression ratio. This variable compression ratio device is provided with a multiple-link type variable mechanism that consists of multiple links, including a connecting rod connected to the piston so as to allow for a rocking motion. By rotation-driving a control shaft with an actuator, the rocking bearing of the control link is changed, which in turn changes the piston stroke.

SUMMARY

For the variable compression ratio device with the aforementioned configuration, detecting the rotation angle of said control shaft also allows for detection of the compression ratio. However, conventionally speaking, since the base control position for the control shaft was not regulated, the accuracy in detecting the compression ratio was likely to deteriorate due to various fluctuations.

The purpose of the present invention is to provide a variable compression ratio device for an internal combustion engine that regulates the base control position of the variable compression ratio device and can thus correct the fluctuations that occur in the compression ratio sensor.

In order to achieve the above, the variable compression ratio device for an internal combustion engine pertaining to the present invention is provided with a stopper on at least the side that has the highest compression ratio to regulate the displacement of the mechanism member that takes place with the change in said compression ratio. In addition, the variable compression ratio device for an internal combustion engine pertaining to the present invention is also provided with a base position detecting means that detects the position of the mechanism member so that it is positioned in the base position on the highest compression ratio side as it becomes displaced with the change in the compression ratio.

According to the above configuration, since the displacement of the mechanism member that takes place with the change in the compression ratio is regulated by a stopper, the position in which the mechanism member is stopped by the stopper can be regulated as the base control position of said mechanism member, and the position of the mechanism member detected by the base position detecting means can also be regulated as the base control position. Therefore, it becomes possible to displace the mechanism member based on said base control position, thus allowing for adjustment of the compression ratio so that accurate adjustment of the compression ratio can be performed at the high compression ratio side where the effects on the knocking and fuel economy are the greatest.

EXPLANATION OF THE REFERENCE SYMBOLS

| | |
|---|---|
| 1 | Internal combustion engine |
| 34 | Lower link |
| 35 | Upper link |
| 40 | Control link |
| 42 | Control shaft |
| 43 | Actuator |
| 101 | Engine control unit (ECU) |
| 102 | Revolution speed sensor |
| 103 | Load sensor |
| 104 | Compression ratio sensor |
| 105 | Cylinder internal pressure sensor |

DETAILED DESCRIPTION

An embodiment for enforcing the present invention is explained below with reference to the Drawings.

Figure 1:
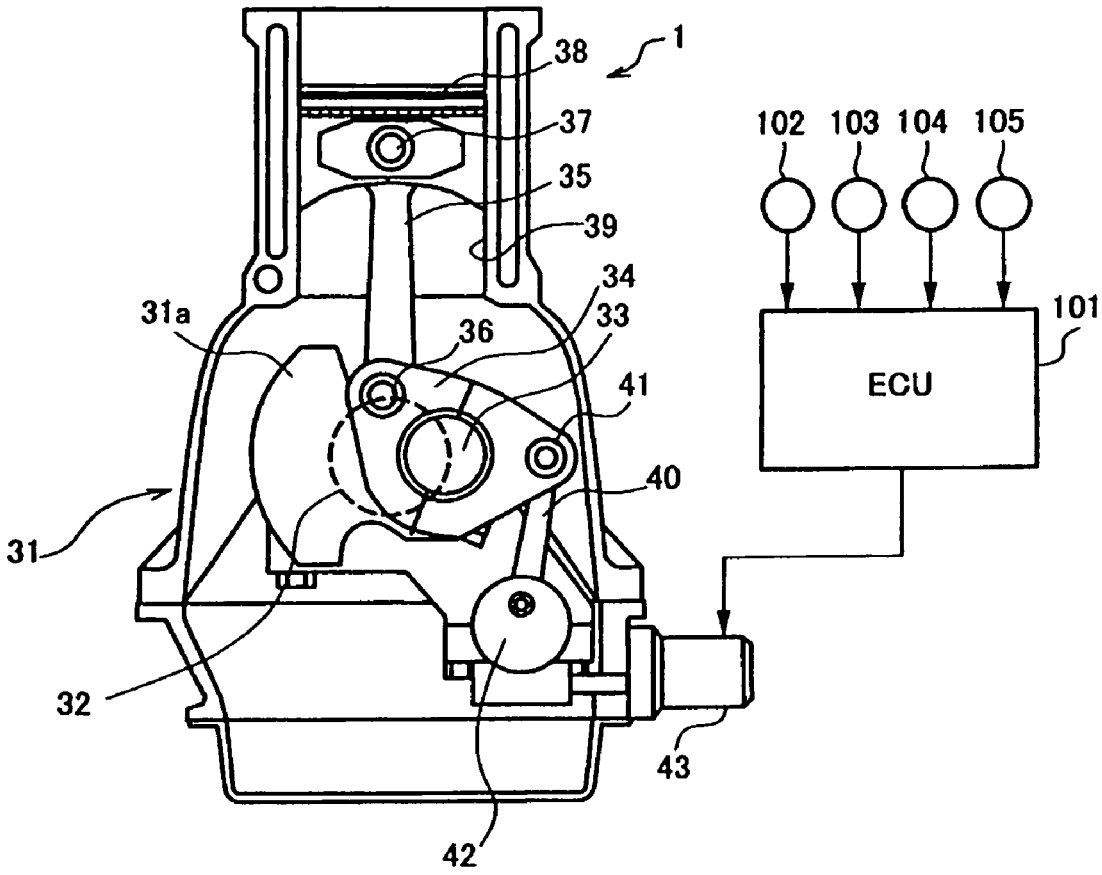
FIG. 1 illustrates an embodiment of the variable compression ratio mechanism.

FIG. 1 shows a variable compression ratio device and its control system for this embodiment. In FIG. 1, crankshaft 31 of internal combustion engine 1 is provided with multiple journal portions 32, crank pin 33 and counterweight 31*a*. Multiple journal portions 32 are rotatably supported on the main bearing (not shown in FIG. 1) of the cylinder block. Crank pin 33 is eccentrically placed from multiple journal portions 32 by a prescribed amount, at which point lower link 34 is rotatably connected. Crank pin 33 is mated to a connecting hole located in approximately the center of lower link 34. The lower end of upper link 35 is movably connected to one end of lower link 34 via connector pin 36, and the upper end is movably connected to piston 38 via piston pin 37. Piston 38 receives combustion pressure and reciprocates inside of cylinder 39 of the cylinder block.

An upper end of a control link 40 is movably connected to the other end of lower link 34 via connector pin 41. In addition, the engine unit rotatably supports a control shaft 42. A lower end of control link 40 is rockably supported in a position that is slightly shifted from the shaft center of control shaft 42.

According to the above configuration for the variable compression ratio mechanism, control shaft 42 is rotated by actuator 43, and the position of the lower end of control link 40 that is rockably supported changes. When the rockably supported position of said control link 40 changes, the stroke of piston 38 changes so that the position of the top dead center (TDC) of piston 38 gets higher and lower and the compression ratio changes. In other words, the variable compression ratio mechanism for the present embodiment is a mechanism in which the compression ratio changes in accordance with the rotation angle of control shaft 42, and because it is a multiple-link type of mechanism, the compression ratio can be changed while achieving a compact configuration. A hydraulic cylinder, motor, or an electromagnetic solenoid may be used for actuator 43.

Figure 2:
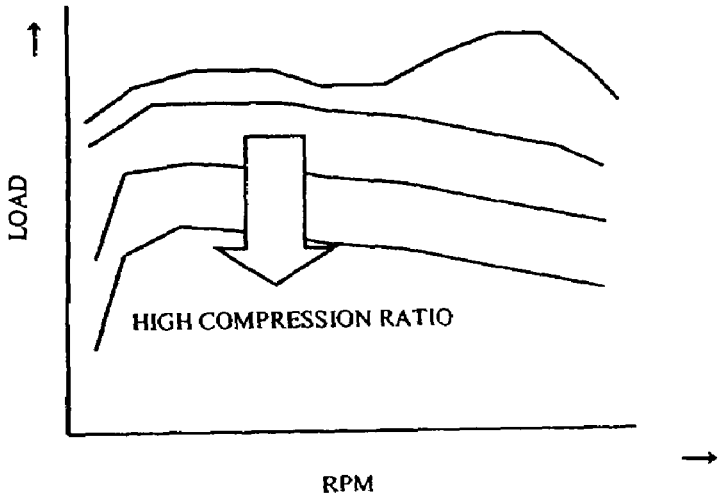
FIG. 2 is a diagram showing the characteristics of the target compression ratio, according to an embodiment of the invention.

Engine control unit (ECU) 101, which controls the compression ratio by controlling actuator 43, is configured to include a microcomputer, and feedback controls actuator 43 so that the target compression ratio, pre-memorized for each individual operating range, is consistent with the actual compression ratio. The target compression ratio is set according to the engine RPM or the engine load, for example, and basically speaking, the compression ratio is set to a high level when at low load in an attempt to achieve better fuel economy and is set to a low level when at high load in order to avoid the occurrence of knocking (see FIG. 2).

The signals detected from revolution speed sensor 102 and load sensor 103 are input to ECU 101, and the target compression ratio that corresponds to the operating conditions for that time are set in accordance with the signals detected. A compression ratio sensor 104 is provided for detecting the compression ratio by using a potentiometer, for example, in order to detect the angle of rotation of control shaft 42. ECU 101 calculates the feedback control signal based on the deviation between the compression ratio detected by compression ratio sensor 104 and the target compression ratio. ECU 101 adjusts the compression ratio to the target compression ratio by drive-controlling actuator 43 based on the feedback control signal.

In addition to the above configuration, for the present embodiment, a stopper that regulates the rotation (displacement) of control shaft 42 (the mechanism member) is provided on at least the side with the highest compression ratio so that control shaft 42 does not rotate beyond the position for which rotation is regulated by said stopper and move further toward the high compression ratio side, but instead ensures that the low compression side is the movable range for control shaft 42, rather than the position for which rotation is regulated by said stopper. As explained below, by using the position of control shaft 42 that is regulated by the stopper as the base to detect the compression ratio, the effects due to fluctuations that occur in compression ratio sensor 104 are significantly reduced and may be substantially eliminated so that the compression ratio can be accurately controlled.

The stopper is disposed at the front of the engine at first journal portion 32 of crankshaft 31. Using a configuration in which the stopper is disposed at the front of the engine at first journal portion 32, there is no need to provide space to place a stopper in the middle of control shaft 42, so there is no effect on the width of the bearing for control shaft 42, the width of the eccentric cam or the width of the counterweight, and the performance of the bearing does not deteriorate.

Figure 3:
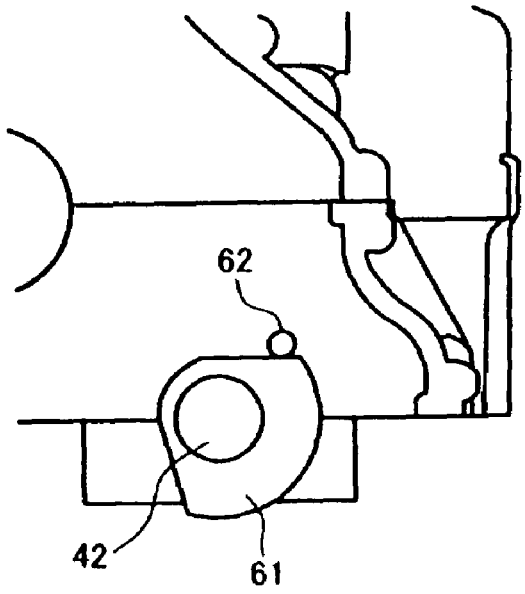
FIG. 3 is an example of a stopper structure for a control shaft, according to another embodiment of the invention.

As shown in FIG. 3, for example, the stopper is comprised of fan-shaped stopper member 61, disposed on the control shaft. A stopper member 62, located on the main unit side, consists of a pin that is pressed into the cylinder block. When control shaft 42 rotates to the high compression ratio side, stopper member 61 integrally rotates with control shaft 42, abuts with stopper member 62 at a prescribed angle, and stops, thus preventing control shaft 42 from rotating any further in the direction of the high compression ratio side.

Figure 4:
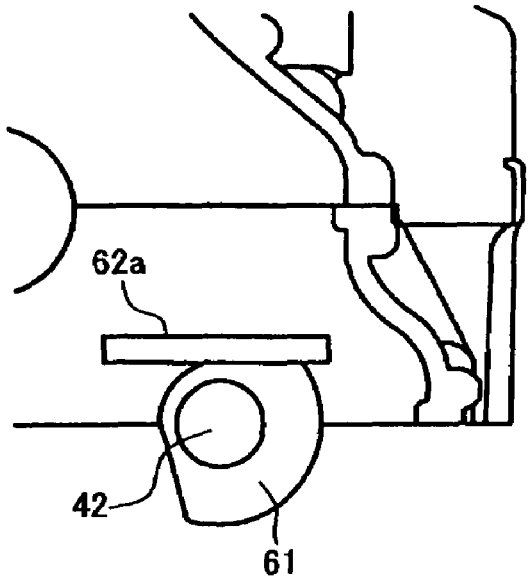
FIG. 4 is another example of a stopper structure for a control shaft, according to another embodiment of the invention.

As shown in FIG. 4, a stopper member 62*a*, located at the main unit side, is plate-shaped, and circular movement of control shaft 42 is permitted within an angle range that is between the position at which one side edge of fan-shaped stopper member 61 abuts with plate-shaped stopper member 62*a* (highest compression ratio side) and the position at which the other side edge abuts with plate-shaped stopper member 62*a* (lowest compression ratio side).

For another embodiment, an additional pin can be added to the configuration of FIG. 3 to regulate the rotation at the lowest compression ratio side. This enables the rotation of control shaft 42 to be regulated at both the highest compression ratio side and the lowest compression ratio side. Furthermore, the shape of the stopper is not limited to those shown in FIG. 3 or 4, and as long as it functions as a stopper, it is obvious that various shapes and structures can be applied.

For the variable compression ratio device pertaining to the present embodiment, the load from the combustion pressure operates to move control shaft 42 toward the low compression ratio side. When the torque from actuator 43, which moves control shaft 42 to the high compression ratio side, stops control shaft 43 moves to the low compression ratio side. Therefore, when a failure occurs and the rotating torque from actuator 43 stops, the vehicle can be operated at the low compression ratio side, and the occurrence of knocking can be avoided.

Figure 5:
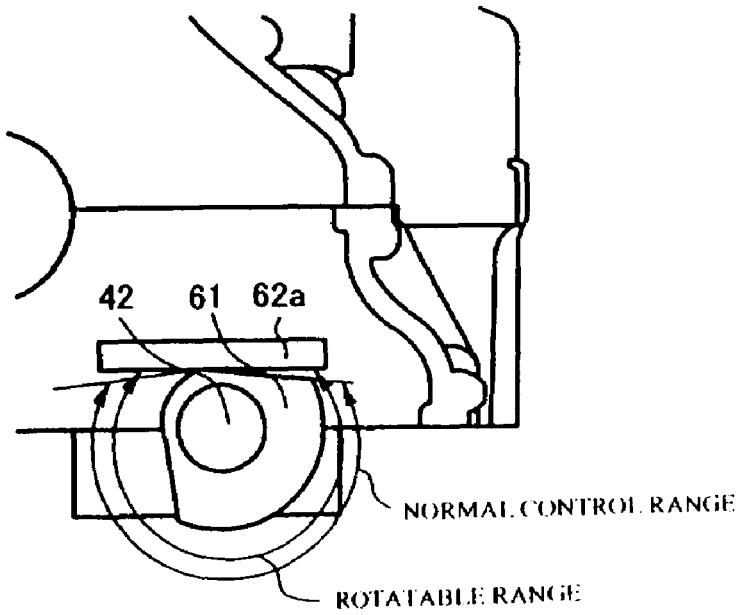
FIG. 5 illustrates a correlation between a movable range and a normal control range of a control shaft, according to another embodiment of the invention.

FIG. 5 shows a correlation between the movable range for control shaft 42 as regulated by the stopper and the moving control range (normal control range) for control shaft 42 that corresponds to the range set as the target compression ratio for when the stopper is used to regulate the rotation of control shaft 42 at both the highest compression ratio side and the lowest compression ratio side, as shown in FIG. 4. As shown in FIG. 5, the moving control range (normal control range) is included within the rotatable range regulated by the stopper position and even under operating conditions in which the highest or lowest compression ratio is set as the target compression ratio, the moving control range can be set so that control shaft 42 can be moved as far as the rotation angle immediately before the stopper member abuts. Therefore, under normal compression ratio control, the noise caused by the stopper member abutting does not occur and in addition, since the stopper member does not abut under normal compression ratio control, the amount of wear of the stopper member can be deterred.

Figure 6:
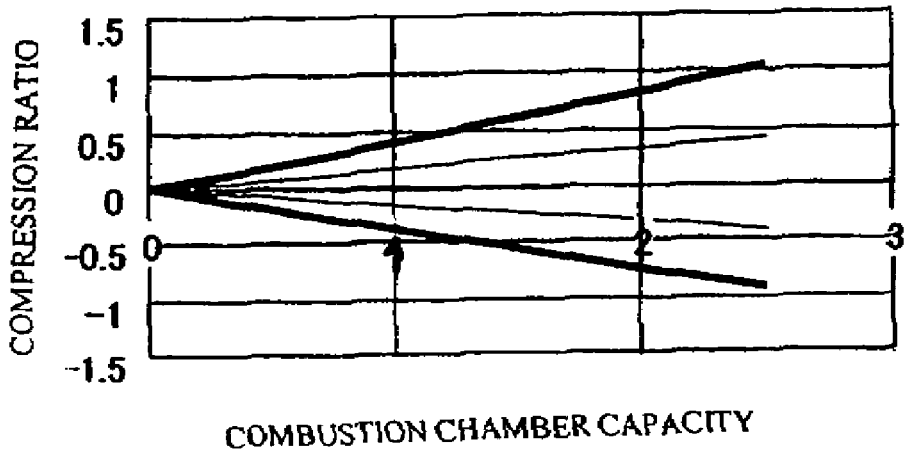
FIG. 6 illustrates a correlation between a change in a combustion chamber capacity and a change in a compression ratio at a high compression ratio side and a low compression ratio side, according to another embodiment of the invention.

For the present embodiment, as explained below, the position of the angle of control shaft 42 regulated by the stopper is used as the initial base position (initial base angle). Fluctuations in the sensor output characteristics are detected from the sensor output at the initial base position, and adjustment of the sensor output is performed. Since it is desirable to perform this adjustment control with the high compression ratio side as the initial base position, however, a stopper should be provided on at least the highest compression ratio side. Following is provided an explanation for the reason that the output from compression ratio sensor 104 is adjusted with the high compression ratio side as the base:

FIG. 6 shows the relationship between the change in the capacity of the combustion chamber and the change in the compression ratio. The bold lines in FIG. 6 indicate the correlation at the high compression ratio side, and the thin lines indicate the correlation at the low compression side. The combustion chamber capacity is small at the high compression ratio side, and the same amounts of change in the combustion chamber capacity increase in proportion to the combustion chamber capacity occupied by the high compression ratio side. Therefore, as shown in FIG. 6, the amount of fluctuation in the compression ratio increases at the high compression side in relation to the amounts of change in the combustion chamber capacity. Therefore, the output from compression ratio sensor 104 is adjusted with the high compression ratio side as the base. By performing accurate adjustment control at the high compression ratio side, fluctuations can be effectively controlled that occur in the compression ratio that is controlled in accordance with the angle of control shaft 42 detected by compression ratio sensor 104.

Figure 7:
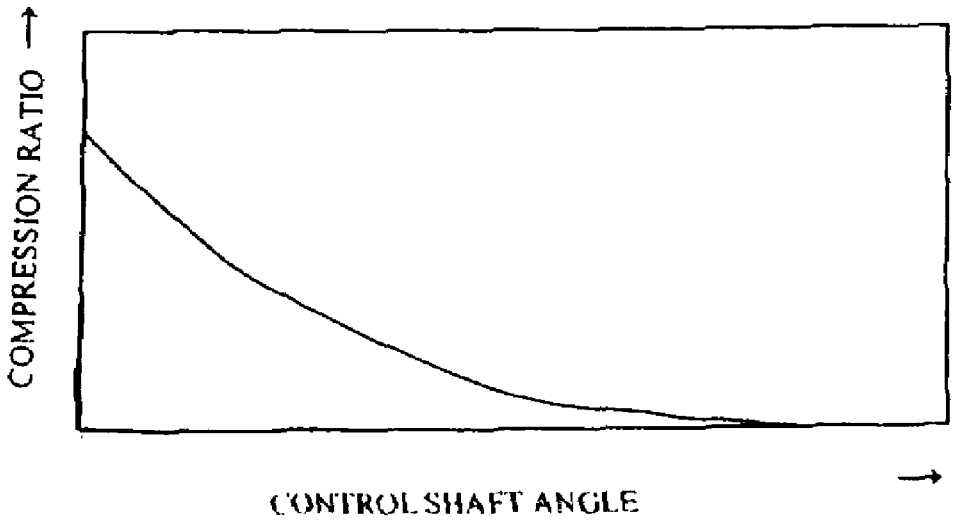
FIG. 7 is a diagram showing a correlation between an angle of a control shaft and a compression ratio, according to another embodiment of the invention.

FIG. 7 shows the correlation between the angle of control shaft 42 and the compression ratio for the variable compression ratio mechanism pertaining to the present embodiment. As shown in FIG. 7, the amount of change in the compression ratio per unit of angle of control shaft 42 is set so that it increases the further the shaft moves toward the high compression ratio side. Therefore, the compression ratio can be detected at a high resolution at the high compression side, which is the initial base position.

Figure 8:
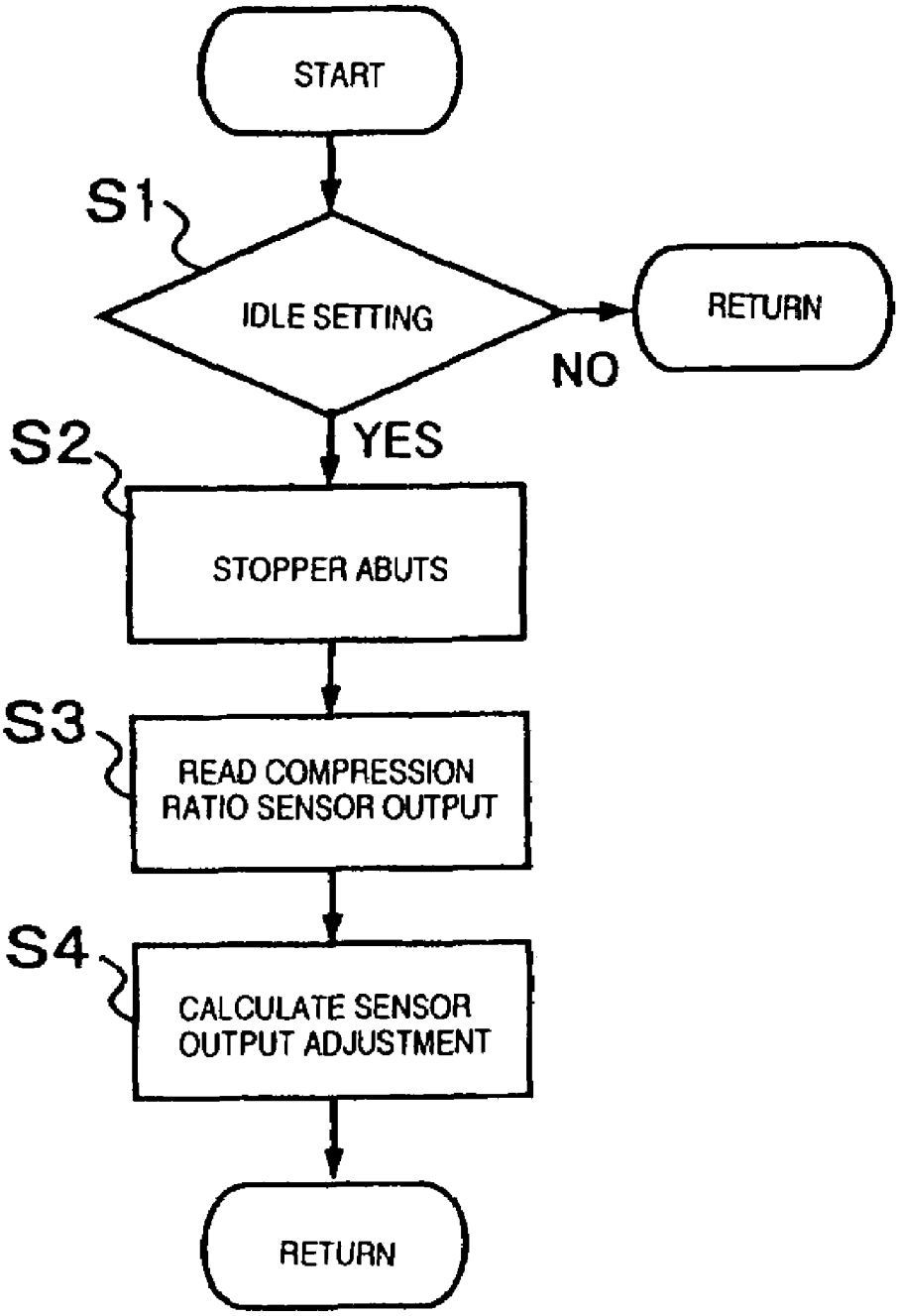
FIG. 8 is flowchart showing a learning control for a sensor output adjustment value at initial base angle, according to another embodiment of the invention.

FIG. 8 is a flowchart for ECU 101 showing the adjustment control for compression ratio sensor 104 based on the stopper position at the highest compression ratio side. In Step S1, it is determined whether or not the engine is in an idle setting mode. The idle setting mode is when the engine is operating in idle. That is, when cranking takes place when the engine is in low load, such as immediately before the key switch is turned off or when the engine is operating under low RPM and the combustion pressure and main kinetic inertial forces are small, the displacement of the piston position can be ignored and thus, the initial position can be accurately detected.

When in the idle setting mode, the process proceeds to Step S2, and control shaft 42 is moved to the position in which rotation is regulated by the stopper (the position at which the stopper abuts) at the highest compression ratio side. Specifically, actuator 43 generates a rotating drive force that rotates the rotation angle of control shaft 42 toward the high compression ratio side to a position that is beyond the position of the stopper on the high compression ratio side. At the point at which the change in the angle detected by compression ratio sensor 104 stops, the sensor determines that the stopper member has abutted. At Step S3, the output (output voltage) detected by compression ratio sensor 104 is read at the state at which the movement of control shaft 42 is regulated by the stopper.

Figure 9:
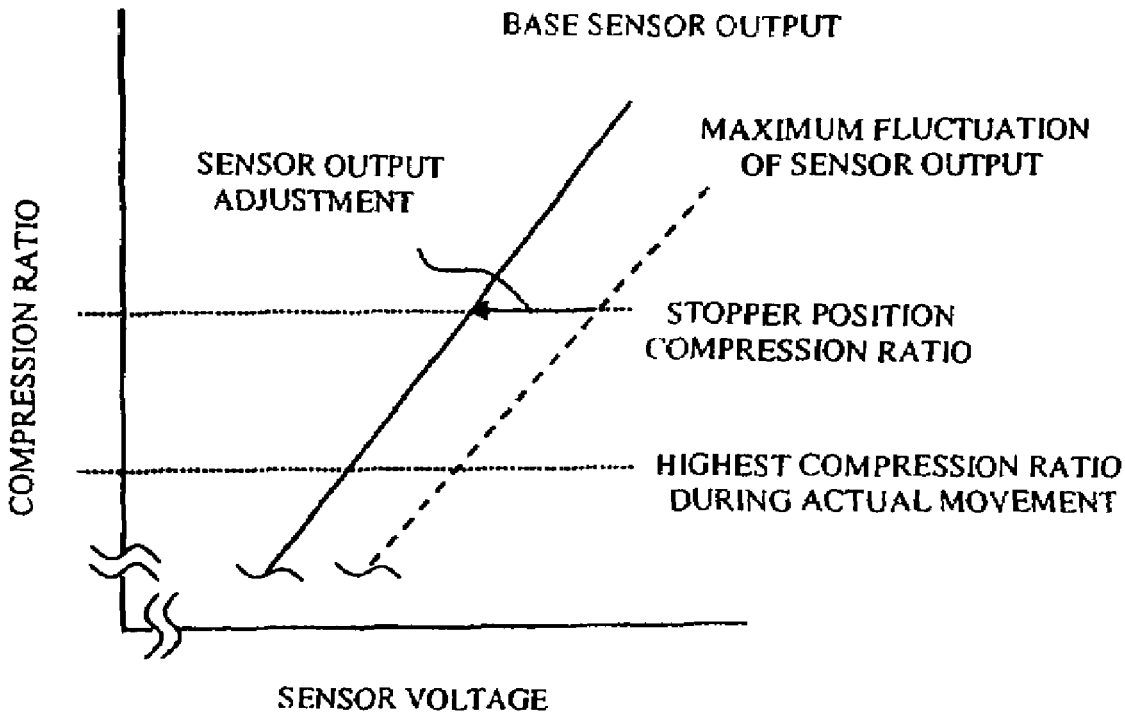
FIG. 9 is a diagram for explaining characteristics of a sensor output adjustment value, according to another embodiment of the invention.

At Step S4, using the difference between the sensor output (base output) corresponding to the stopper position at the high compression ratio side and the sensor output actually read in Step S3 with a base correlation (base sensor output characteristic) between the output detected by compression ratio sensor 104 and the compression ratio, the sensor output for when the stopper has abutted is adjusted to the base output and learned as the sensor output adjustment value (offset adjustment value) (see FIG. 9). Then, the base sensor output characteristics are referenced in accordance with the adjusted sensor output that is based on the adjusted value of the sensor output, and the compression ratio is detected. In this manner, the fluctuations in the sensor output characteristics are absorbed and accurate detection of the compression ratio can be maintained.

Instead of storing the sensor output adjustment value, the sensor output for the stopper position (base sensor output) can be stored and the detection characteristics of the compression ratio can be adjusted each time based on the sensor output for the stopper position and said base output.

Based on the configuration described above, even if fluctuations in the output characteristics of compression ratio sensor 104 occur, the compression ratio of the engine can be accurately detected, and it can be controlled to the target compression ratio under each operating condition. Furthermore, the fluctuations in the output from compression ratio sensor 104 cause greater errors in the compression ratio at the high compression ratio side, so the adjusted value for the sensor output can be learned based on the sensor output at the stopper position on the high compression ratio side in order to perform a more accurate adjustment at the high compression ratio side and more effectively control the errors that take place when controlling the compression ratio.

In the case of the present embodiment, as shown in FIG. 7, the amount of change in the compression ratio per unit of angle for control shaft 42 has a tendency to increase more at the high compression ratio side, so accurate adjustment of the sensor output can be achieved at the high compression side, which is the initial base position.

At this point, if the absolute value of the adjusted value exceeds the threshold value, a fail verification is performed (an error verification signal is output); failsafe testing that is limited to the data memorized by the fail verification (output of an error verification signal) and to a compression that is less than a prescribed value is performed; and operation of the alarm device (an alarm lamp lights up) provided near the driver's seat of the vehicle is performed.

As explained above, by providing a configuration in which a fail verification is performed based on the adjusted value, performing excessive adjustments when compression ratio sensor 104 fails that result in continuous control of the compression ratio can be avoided, and the occurrence of knocking and decreased fuel economy can be kept reduced.

Figure 10:
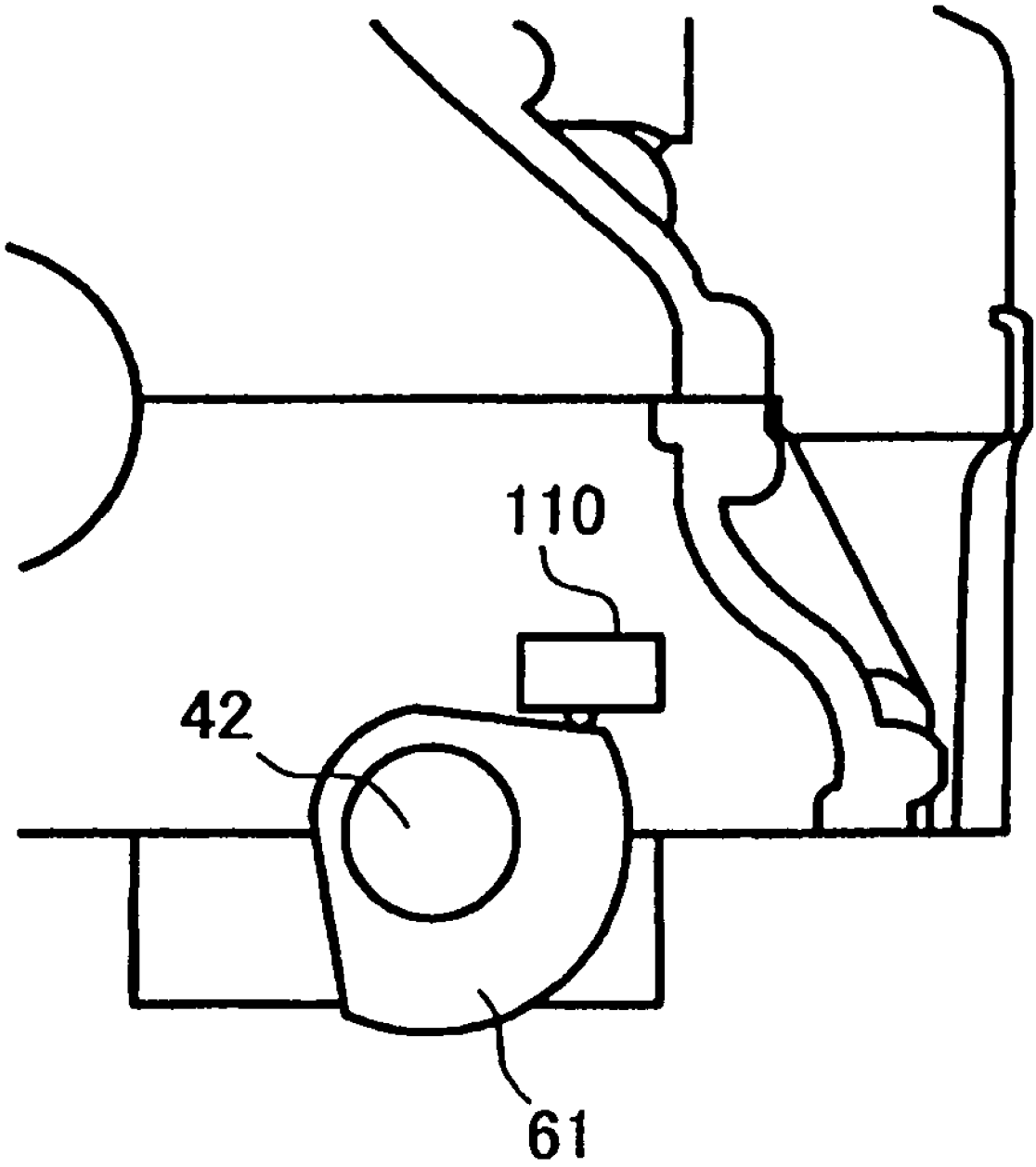
FIG. 10 illustrates an embodiment provided with a base position detecting means.

Although the embodiment described above is configured so that the initial base angle at the high compression ratio side is regulated by the position of a stopper, instead of providing a stopper, base position detecting means 110, such as a micro switch or a proximity switch, can be provided as shown in FIG. 10. Position detecting means 110 detects whether control shaft 42 is positioned at the initial base angle of the high compression ratio side by switching between ON and OFF and then performing adjustment control of compression ratio sensor 104.

When base position detecting means 110 is provided and it detects that the rotation angle of control shaft 42 is at the initial base angle, the value detected by compression ratio sensor 104 can then be read. Based on the detection output that is read, the detection characteristics of the compression ratio can be adjusted in accordance with the sensor output, and then the fail verification can be performed based on this adjusted value. Furthermore, when base position detecting means 110 is provided, the occurrence of adjustment errors in the sensor output due to the wear and deformity of the stopper are substantially eliminated, as explained below, allowing for stable sensor adjustment control.

When the initial base angle of control shaft 42 is regulated with a stopper and the rotation of control shaft 42 is regulated and the position in which it stops shifts more toward the high compression ratio side, the wrong adjustment value for the sensor output is learned in an attempt to match the sensor output that is read at this point with the base output. As a result, the value detected for the compression ratio is smaller than the actual compression ratio, so when control shaft 42 is rotated from the initial base position and the compression ratio is lowered, it gets controlled to a higher compression ratio than the target value. Therefore, as shown in the flowchart for FIG. 12, compensation control is performed to offset the wear and deformity of the stopper.

Figure 12:
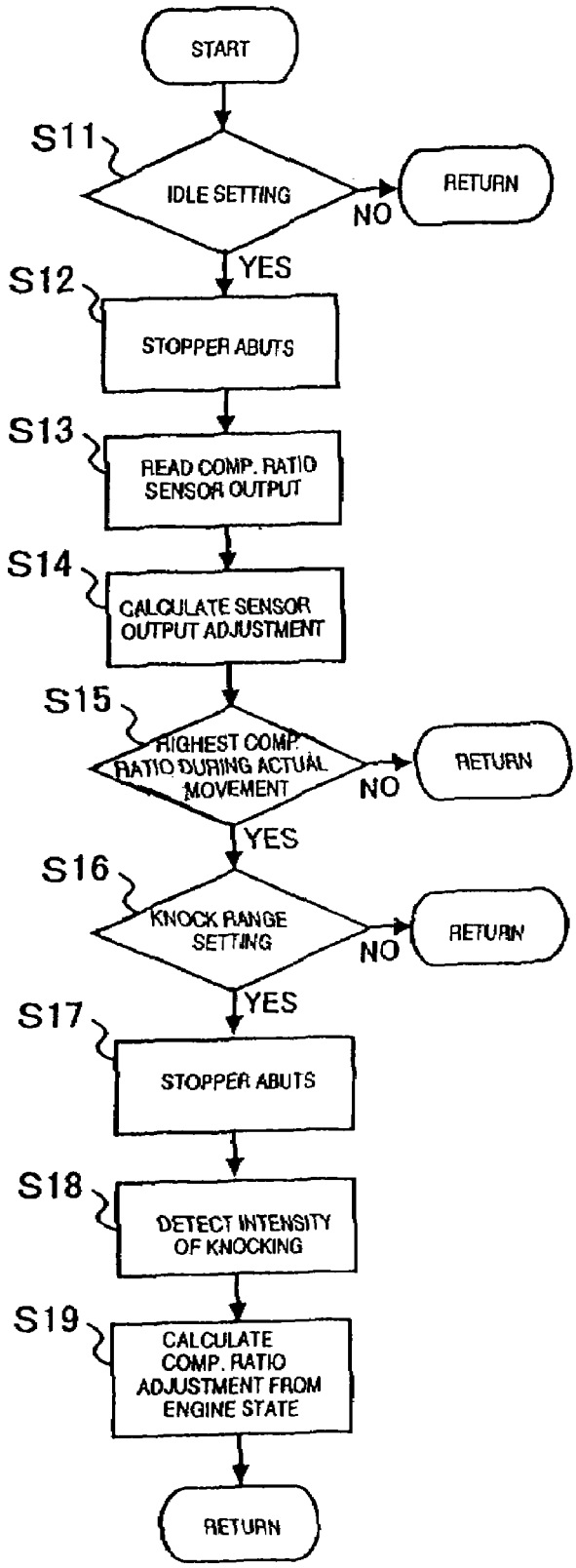
FIG. 12 is a flowchart showing an adjustment control for a shift in a stopper position to a high compression ratio side due to wear and deformity of the stopper, according to another embodiment of the invention.

The process for Steps S11-S14 in the flowchart shown in FIG. 12 is carried out in the same manner as that for Steps S1-S4 for the flowchart shown in FIG. 8, explained above. At Step S15, it is determined whether or not control has been performed to set the compression ratio to the highest target compression ratio from the target compression ratios in accordance with the operating conditions. If control has been performed to set it to the highest target compression ratio, the process proceeds to Step S16, and it is then determined whether or not the mechanism is within the knocking detection range that has been pre-set by the current operating conditions.

Figure 11:
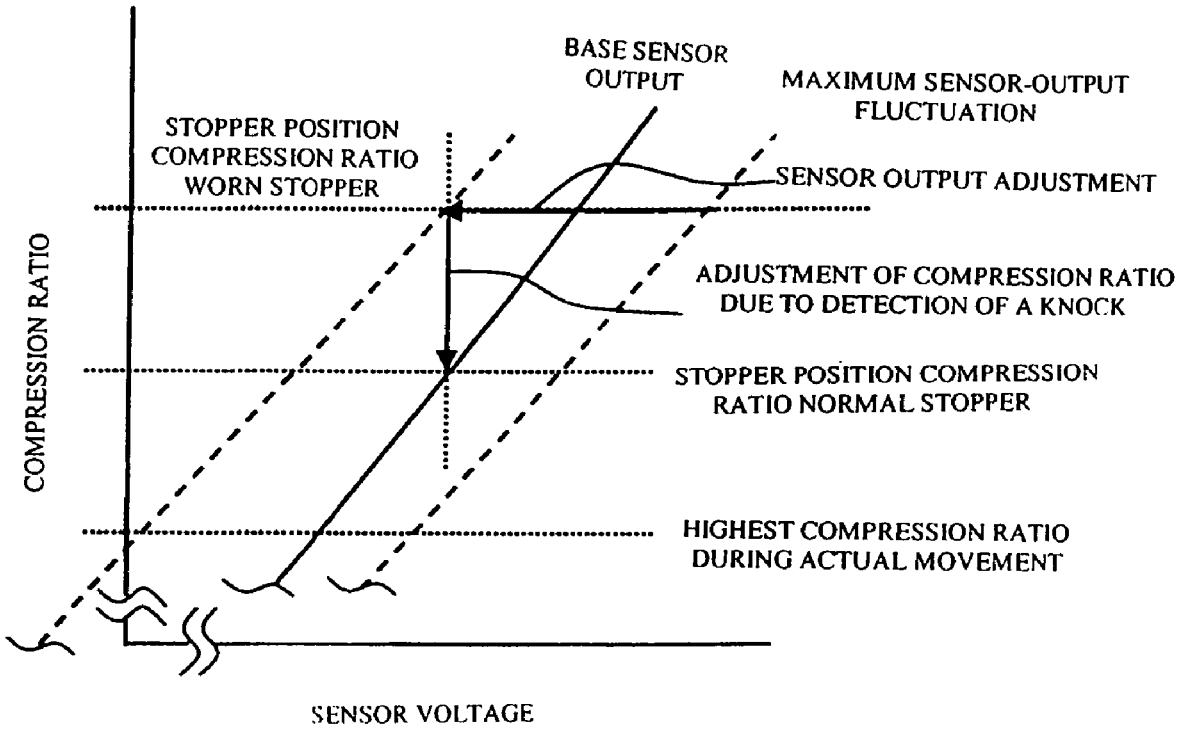
FIG. 11 is a diagram for explaining an adjustment control for a shift in a stopper position to a high compression ratio side due to wear and deformity of a stopper, according to another embodiment of the invention.

When the compression ratio has been set to the highest target compression ratio from the target compression ratios and the mechanism is within the prescribed knocking detection range, the process proceeds to Step S17, and control shaft 42 is rotation-driven to the high compression ratio side where it should hit up against the stopper at the highest compression ratio side. At Step S18, the intensity of the knocking that takes place at that point is detected based on the detection signal from cylinder internal pressure senor, or knock sensor, 105. At Step S19, if it is determined that the knocking intensity detected in Step S18 is greater than the knocking intensity predicted by the operating conditions, a revised compression ratio value is set that adjusts the compression ratio to a higher level than the detected compression ratio. (Refer to FIG. 11.)

If the knocking that takes place when the control shaft is abutted with the stopper is more intense than that which took place in the initial state, the stopper changes the regulating position of control shaft 42 more toward the high compression ratio side than the initial position due to the wear and deformity of the stopper and as a result, the compression ratio for when the stopper is abutted increases and thus the knocking is determined to have gotten more intense. When the position of the stopper gets shifted to the high compression ratio side, the detected compression ratio that is based on the sensor output adjusted by the sensor adjustment value becomes smaller than the actual compression ratio, causing the compression ratio to be controlled to a higher value than the target value, so a compression ratio adjustment value for adjusting the detected compression ratio that should correspond with the shift in the position of the stopper to the high compression ratio side is set in accordance with the intensity of the knocking that indicates the amount of shift in the position of the stopper to the high compression ratio side.

It is possible to estimate the actual compression ratio from the engine load and RPM and the intensity of the knocking that takes place at that time and the difference in the compression ratio of the initial stopper position and the compression ratio obtained by the estimation is the increased adjustment value of the detected compression ratio for when the stopper is in the abutted state. In this case, as shown in FIG. 7, the amount of change in the compression ratio per unit of angle for control shaft 42 has a tendency to increase as it moves further toward the high compression ratio side, so the required amount for the compression ratio adjustment value increases as the control shaft moves further toward the high compression ratio side and decreases at the low compression ratio side, so the compression ratio adjustment value at the low compression ratio side is set using characteristics that are preset for each detected compression ratio on a basis of the increased adjustment value of the detected compression ratio for when the stopper is in the abutted state.

If the result of the compression ratio detected by the compression ratio adjustment value is revised, even if the stopper gets worn or deformed, accuracy can be maintained in detecting the compression ratio with compression ratio sensor 104 on the basis of the stopper position. At this point, if said compression ratio adjustment value is more than a prescribed value and it is estimated that the amount of shift in the position of the stopper is more than a prescribed value due to the wear and deformity of the stopper, fail verification is performed (an error verification signal is output), failsafe testing that is limited to the data memorized by the fail verification (output of an error verification signal) and to compression that is less than a prescribed value is performed and operation of the alarm device (an alarm lamp lights up) provided near the driver's seat of the vehicle is performed.

What is claimed is:

1. A variable compression ratio device for an internal combustion engine, comprising:

a lower link rotatably connectable to a crankshaft of the engine;

an upper link movably connectable between the lower link and a piston of the engine;

a shaft rotatably connectable to the engine and movably connected to the lower link; and a stopper member attached to the shaft for rotation therewith and operable to regulate a displacement of the shaft wherein the displacement of the shaft moves the top dead center position of the piston via the lower and upper links.

2. The variable compression ratio device of claim 1, and further comprising an actuator connected to the shaft.

3. The variable compression ratio device of claim 2, and further comprising a controller coupled to the actuator.

4. The variable compression ratio device of claim 3, and further comprising at least one of a compression ratio sensor, a load sensor, a revolution speed sensor, and a cylinder internal pressure sensor coupled to the controller.

5. The variable compression ratio device of claim 1, wherein the stopper member ensures that a position in which the shaft stops is set outside of a required range of change of a compression ratio of the engine.

6. The variable compression ratio device of claim 1, wherein the stopper member is positioned at a first journal portion of a front side of the engine.

7. The variable compression ratio device of claim 1, wherein the stopper member ensures that an output value of a compression ratio sensor is stored as a base sensor output when the shaft is in a stopped state.

8. The variable compression ratio device of claim 1, wherein the stopper member ensures that an error-determining signal is output when an output value of a compression ratio sensor exceeds a threshold value when the shaft is in a stopped state.

9. The variable compression ratio device of claim 1, wherein the stopper member ensures that a compression ratio sensor output adjustment value for revising a result of a compression ratio detected by the compression ratio sensor is learned based on a value output by the compression ratio sensor when the shaft is in a stopped state.

10. The variable compression ratio device of claim 1, wherein the stopper member ensures that a measure of knocking inside of a cylinder containing the piston is detected, and based on the measure of the knocking inside of the cylinder, a compression ratio sensor output adjustment value for revising a result of a compression ratio detected by the compression ratio sensor is learned based on a value output by the compression ratio sensor when the shaft is in a stopped state.

11. The variable compression ratio device of claim 10, wherein an error-determining signal is output when the compression ratio adjustment value exceeds a threshold value.

12. The variable compression ratio device of claim 1, wherein a position in which the shaft is regulated by the stopper member is forcibly displaced when the engine is in a low revolution/low load operating state.

13. An internal combustion engine with a variable compression ratio, comprising:

a piston that moves back and forth inside a cylinder;

a crankshaft;

a lower link rotatably connected to an eccentric shaft that is eccentric to the center rotation of the crankshaft;

an upper link with one end connected to the piston and the other end connected to the lower link;

a control link with one end connected to the lower link, wherein the position in which the control link is connected is on the opposite side of the position in which the upper link is connected with the eccentric shaft sandwiched between them;

a mechanism member to which the other end of the control link is connected so as to allow for the movement of this other end in the back and forth direction of the piston wherein the mechanism member is movable between a low compression ratio side and a high compression ratio side, a position of the mechanism member indicating a compression ratio of the engine;

a stopper member operable to regulate a displacement of the mechanism member at least at the high compression ratio side; and a controller operable to:

set a target compression ratio of the engine; and output a signal indicating the position of the mechanism member based on the target compression ratio of the engine.

14. The internal combustion engine of claim 13, wherein the mechanism member comprises a control shaft coupled to an actuator.

15. The variable compression ratio device of claim 14, and further comprising at least one of a compression ratio sensor, load sensor, a revolution speed sensor, and a cylinder internal pressure sensor coupled to the controller.

16. An internal combustion engine with a variable compression ratio, comprising:

means for converting a back and forth movement of a piston to a crankshaft rotation;

means for changing a rotation angle of a control shaft to change a range of back and forth movement of the piston and the compression ratio;

means for regulating a displacement of the means that changes the compression ratio at the highest compression ratio side; and means for generating an error-determining signal when an output value of a compression ratio sensor exceeds a threshold value.

17. The internal combustion engine of claim 16, and further comprising means for determining a compression ratio sensor output adjustment value.

18. The internal combustion engine of claim 16, and further comprising means for forcibly displacing the means that changes the compression ratio at the highest compression ratio side when the engine is in a low revolution/low load operating state.

19. The internal combustion engine of claim 16, and further comprising means for determining a measure of knocking inside of a cylinder of the engine.

20. The internal combustion engine of claim 16, and further comprising means for revising a result of a compression ratio detected by a compression ratio sensor based on a measure of knocking inside of a cylinder of the engine.

21. The internal combustion engine of claim 16, and further comprising means for detecting a base position of the means that changes the compression ratio at the highest compression ratio side.

22. A method of operating an internal combustion engine with a variable compression ratio, the method comprising:

controlling a location of a top-dead-center position of a piston of the engine using a mechanism member coupled to the piston;

limiting a displacement of the mechanism member at least on a side corresponding to a highest compression ratio of the engine using a stopper; and using a value output by a sensor when the mechanism is in a stopped state at the displacement allowed by the stopper at the side corresponding to the highest compression ratio of the engine to revise a result of a compression ratio indicated by the sensor.

23. The method of claim 22, and further comprising limiting the displacement of the mechanism member to the side corresponding a highest compression ratio of the engine and a side corresponding a lowest compression ratio of the engine using the stopper.

24. The method of claim 22, wherein controlling a location a top-dead-center position of a piston of the engine is in response to the mechanism member receiving a signal indicative of a deviation between a compression ratio based on the displacement of the mechanism member and a target compression ratio.

25. The method of claim 24, wherein the target compression ratio of the engine is based on an engine load or engine speed.

26. The method of claim 25, wherein the engine load is based on a measurement of a combustion pressure within a cylinder containing the piston.

27. The internal combustion engine of claim 15, wherein the stopper member comprises a first stopper portion attached to the shaft for rotation therewith and a second stopper portion fixedly mounted in a position adjacent the shaft such that the stopper member engages when the first stopper portion abuts the second stopper portion when the shaft fully rotates to the high compression ratio side.

28. The internal combustion engine of claim 14, wherein the controller is further operable to:

generate an error signal when an absolute value of an adjusted value of the second, subsequent output signal is greater than a threshold value.

* * * * *